United States Patent [19]

Ohzu et al.

[11] 4,269,257

[45] May 26, 1981

[54] METHOD OF SEQUENTIAL CONTINUOUS-CASTING OF DIFFERENT GRADES OF STEEL

[75] Inventors: Hideshi Ohzu; Hisashi Ohmori; Mizuo Maeda; Hiromi Ohtani, all of Okayama, Japan

[73] Assignee: Kawasaki Steel Corporation, Hyogo, Japan

[21] Appl. No.: 49,885

[22] Filed: Jun. 19, 1979

[30] Foreign Application Priority Data

Jul. 5, 1978 [JP] Japan ..... 53-82246

[51] Int. Cl.[3] ..... B22D 11/06

[52] U.S. Cl. ..... 164/86; 164/82

[58] Field of Search ..... 164/425, 445, 82, 86

[56] References Cited

U.S. PATENT DOCUMENTS 3,789,911 2/1974 Bachuer ..... 164/82

FOREIGN PATENT DOCUMENTS 51-112431 10/1976 Japan ..... 164/82

*Primary Examiner*—Robert D. Baldwin
*Assistant Examiner*—K. Y. Lin
*Attorney, Agent, or Firm*—Koda and Androlia

[57] ABSTRACT

The method of sequential continuous-casting of the different grade of steel according to the present invention comprises the steps of: stopping the pouring of a first grade of molten steel into a mold and the drawing of cast slab; immersing a columnar steel stock being circular or polygonal in cross section and equipped with guiding jigs into the substantially center portion of the first grade of molten steel in said mold; forming a solidified phase around said cooling material; and merging said solidified phase in a solidified shell developed from the wall of the mold to form a solidified layer shutting the upper portion off the lower portion of the first grade of molten steel.

According to the method, the pouring the second grade of molten steel is started before the solidified layer for shutting the upper portion off the lower portion of the first type of molten steel as described above and the surface of the first grade of molten steel is solidified completely, and at the same time, the drawing of the cast slab is started again and the change-over to the normal continuous casting of the second grade of molten steel is effected.

2 Claims, 6 Drawing Figures

METHOD OF SEQUENTIAL CONTINUOUS-CASTING OF DIFFERENT GRADES OF STEEL

BACKGROUND OF THE INVENTION (1) Field of the Invention

The present invention relates to a method of sequential continuous-casting of different grades of steel, and particularly to a method of sequential continuous-casting of different grades of steel wherein cutting loss at the joint portion is very low and the workability of the process is excellent.

(2) Description of the Prior Art

In the case of casting different grades of molten steel by continuous process, heretofore, in general, there has been adopted such a procedure that, upon completion of continuous casting of one grade molten steel, continuous casting of another type of molten steel cannot be started until the preparatory working for continuous casting has been performed all over again. However, the period of time required for the preparatory working for continuous casting usually amounts to 60 to 90 minutes, it has not been avoidable that the casting efficiency is reduced to a considerable extent in the case of conventional working process for the different grades of molten steel.

In the case of changing over from the continuous casting of a first grade of molten steel to a second grade of molten steel that are different in constituent from each other, if the second grade of molten steel which is different in constituent from the first type of is successively poured into the mold by the conventional method without resorting to any appropriate measure, it has been known the fact that mixing is effected between the different grades of molten steel, suction caused by solidification shrinkage and bulging, and diffusion of molten steel and convection caused by difference in temperature, thus resulting in mixing between different grades of molten steel reaching a depth as deep as five to eight meters from the liquid level in a mold. As the result of said mixing action, such a slab in which different grades of molten steel are mixed together is formed in the boundary area between two grades of cast slab which cannot be used as either grade of steel and therefore should be scrapped, thus significantly decreasing the yield of molten steel. Heretofore, there have been proposed various processes for minimizing production of such mixed cast slab.

According to the invention described in the publication of Japanese Patent Application Laid-Open No. 57921/75 representing one of the typical processes, it is intended that the connecting function to connect the different grades of cast slabs to each other is performed by a connecting material such as H-steel, and the mixing occurring between the different grades of cast slabs is completely shut off by charging a coolant material such as nail scrap. However, according to this method, although these are slight differences depending on the types of continuous casting machines used, the tensile load imposed on the connecting material can reach 30 to 100 tons. And, to draw the first grade of cast slab which is continuously cast later, the drawing force is imparted to said cast slab through the connecting material connected to the lower portion of said cast slab and the first grade of cast slab connected to said connecting material. Consequently, it becomes necessary to make the end portions of the respective grades of cast slabs be solidified completely. To attain such solidification, these are presented such disadvantages that the period of time required for treatment should be extended by three to ten minutes, and moreover, such a possibility is very high that, due to notch effect breakdown occurs in a solidified shell caused to the joint portion of the connecting material interposed between the different grades of cast slabs to which said drawing force is imparted, and in turn the joint portion is broken, to thereby allow the molten steel cast to flow downwardly from the water-cooled mold.

Other examples of the prior art are disclosed in the publications of Japanese Patent Application Laid-Open Nos. 112431/76 and 30723/77, for example. These conventional techniques contemplate that one or more stages of partition plates, the center portion of which is open are arranged on the upper surface of the first grade of molten steel, and the second grade of molten steel is poured onto said partition plate or plates to thereby partition the second grade of molten steel off the first grade of molten steel. By this, the purpose has been attained to a certain extent and the cast slab in which the different grades of steel are mixed could be reduced to as short as about one meter. However, in these conventional techniques, as the partition plate or plates have the open center portions, partial mixing between the different grades of molten steel cannot be prevented from occurring, and the best result obtainable by this technique is to shorten the scope of the mixed cast slab to one meter. Further, according to these conventional techniques, there is presented such a disadvantage that, since the partition plate or plates are mounted on the upper surface of the first grade of molten steel, a solidified shell produced in the mold may be broken at a portion of said partition plate or plates, thus resulting in the so-called break-out, i.e. the molten steel leaking out of said portion when the cast slab is drawn.

SUMMARY OF THE INVENTION

The object of the present invention is to obviate the disadvantages of the prior art and provide a method of sequential continuous-casting of different grades of steel wherein cutting loss at joint portions is very low and the workability of the method is excellent.

Other objects and features of the present invention will become apparent more fully from the description of the following embodiment in conjunction with the accompanying drawings. However, the accompanying drawings are intended for explanation only, but not for restricting the scope of the invention.

The abovedescribed objects of the present invention can be achieved by the present invention, the technical gist of which resides in the following.

Namely, in a method of sequential continuous-casting wherein the continuous casting of the first grade of molten steel is changed over to the continuous casting method of the second grade of molten steel, the former and the latter being different in constituent, said continuous casting method comprises the steps of:

stopping the pouring the first grade of molten steel into the mold;

immersing a cooling material into the first grade of molten steel at the substantially center portion of said mold;

forming a solidified layer merging in a solidified shell developed from the wall of said mold and around said cooling material; and pouring the second grade of molten steel into said mold before the upper surface of the first grade of molten steel on the top of said cooling material is solidified.

DETAILED DESCRIPTION OF THE INVENTION

Figure 1:
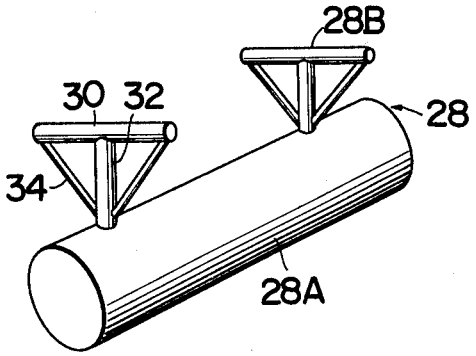
FIG. 1 is an oblique view showing an embodiment of the cooling material equipped with guiding jigs according to the present invention.

Description will hereunder be given of the details of the present invention and one embodiment thereof with reference to the accompanying drawings. Firstly, the pouring of the first grade of molten steel 14 being continuously cast previously from the tundish into the mold 12 is stopped and simultaneously the drawing of the first grade of cast slab is also stopped. At this time, in the first grade of molten steel 14 in the mold 12, a solidified shell 16 of the first grade of cast slab is formed at the wall of mold 12.

Upon stopping pouring of the first grade of molten steel 14, a cooling material 28 comprising a columnar steel stock having a circular or polygonal shape in cross section as shown in FIG. 1 is put in. It is desirable that the cooling material 28 have such a configuration that guiding-members 28B are welded to the steel stock 28A of a circular or polygonal shape in cross section as shown in the oblique view of FIG. 1. As shown in FIG. 1, said guiding jigs 28B are constructed such that a small steel bar 32 is welded to a small steel bar 30 to form a letter 'T' shape, the bottom end of the 'T' shape is welded to a steel stock 28A, and further the opposite ends of the 'T' shape are connected to the bottom end thereof by wires 34 or the like to form an inverted triangular shape. When put into the mold 12, the cooling material 28 is guided by said guiding jigs 28B, so that said steel stock 28A can be readily and correctly introduced into the center position of the mold 12. Except for the shape shown in FIG. 1, the guiding jig 28B can be modified into an inverted triangular plate or the like.

In addition, as for the configuration of the cooling material 28, it is necessary to use one which is large enough in volume to bring the molten steel 14 surrounding it to be cooled and solidified after it is immersed and sunk in the molten steel 14, and therefore, it is desirable to use one capable of satisfying the condition of the following formula.

$$V/S > 1 \text{ cm} \quad (1)$$

where

V: Apparatus cooling volume ($cm^3$)

S: Apparent cooling outer surface ($cm^2$)

The condition of the formula (1) is obtained from experiments. Such a cooling material is preferable that which is infusible to some extent and tends to form a solidified layer therearound because the larger the outer surface of the cooling material contacting the molten steel as compared with the volume, the more easily fusible the cooling material is. Since the cooling material 28 is put into the substantially center portion of the mold 12, and therefore, if the width and thickness of said cooling material are excessively small as compared those of the mold 12, then quick formation of the partition wall may not be realized, and if the width and thickness of said cooling material are excessively large as compared those of the mold 12, then the connection with the solidified shell in the joint portion cannot be secured. Accordingly, the following dimensions in length l and thickness d of the cooling material may be preferable for a mold having the width of about 1500 mm and the thickness of about 220 mm.

Mold width—200 mm<l<Mold width—100 mm

Mold thickness—100 mm<d<Mold Thickness—20 mm

Figure 2:
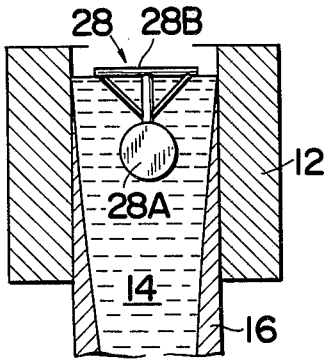
FIG. 2 is a schematic longitudinal sectional view showing the process of immersing the cooling material shown in FIG. 1 into the mold.
Figure 3:
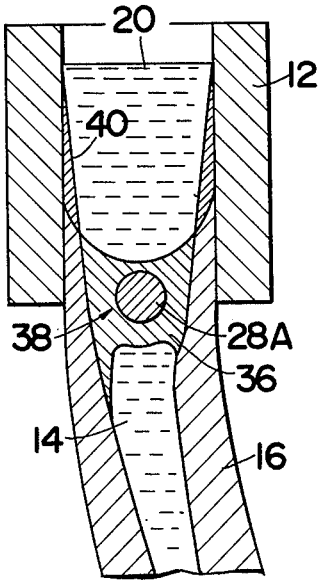
FIG. 3 is a schematic longitudinal, section view showing the solidified layer in the cast slab when the drawing of the cast slab is started after the second grade of molten steel has been poured in the use of the cooling material shown in FIG. 1.

FIG. 2 is an enlarged sectional view showing the condition of the cooling material 28 upon being put in after the pouring of the first grade of molten steel 14 is stopped. In general, the cooling material 28 is larger in specific gravity than the molten steel 14. Then, when put into, the cooling material 28 slowly descends, and is set at the predecided portion of the mold 12 as shown in FIG. 3, then quickly forms a solidified layer 36 therearound. Said solidified layer is connected to a solidified shell 16 of the first grade of molten metal 14, and the cooling material 28, the solidified layer 36 surrounding the cooling material 28 and the solidified shell 16 are integrally formed into a shut-off layer 38.

Figure 4:
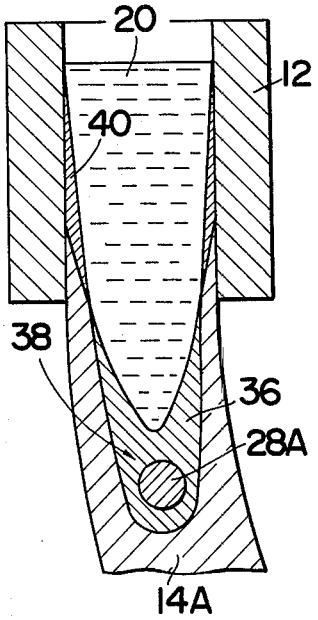
FIG. 4 is a schematic sectional view showing the descending conditions of the joint portion between the different grades of molten steel after the time shown in FIG. 3.
Figure 5A:
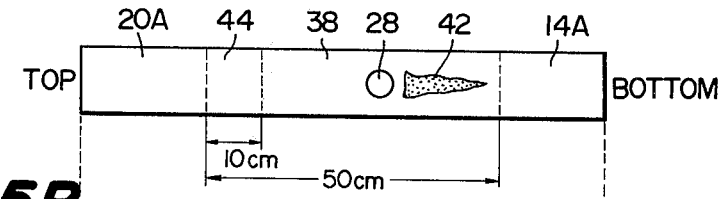
FIG. 5A is a longitudinal sectional view showing the interior of an embodiment of cast slab at a portion adjacent the joint portion of the different grades of steel cast according to the present invention.
Figure 5B:
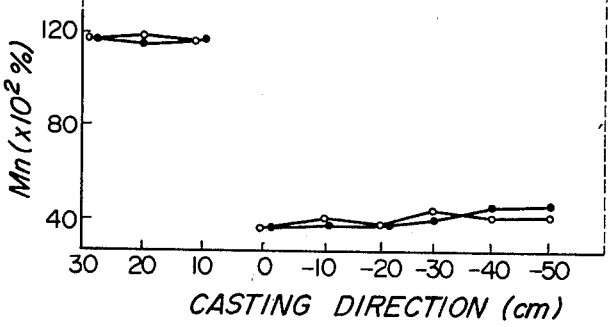
FIG. 5B is a correlational diagram showing the changes in manganese content included in the changes in constituent corresponding to the respective portions of the cast slab adjacent the joint portion thereof as shown in FIG. 5A.

After the replacement of tundish due to the change in the grade of steel, if the pouring of the second grade of molten steel 20 different in constituent onto said shut-off layer 38 is started, then, as shown in FIG. 3, in the mold 12, a cast slab 14A of the first grade of molten steel 14 is formed at the lowermost portion, a provisional bottom composed of the shut-off layer 38 is formed thereon, and the second grade of molten steel 20 is poured still thereonto, whereby a solidified shell 40 of the second grade of molten steel 20 is formed from the portions thereof contacting the shut-off layer 38 and the mold 12, said solidified shell being drawn downwardly. During this process, the guiding jigs 28B used for the put-in which are provided on the steel stock of the cooling material 28 is melted by the first grade of molten steel 14 after the put-in. Although the surface layer of the steel bar 28A is melted to some extent, the steel stock 28A together with the solidified shell formed therearound integrally form the shut-off layer 38 to constitute a joint portion between the first and second grades of molten steel 14 and 20 which will be drawn off as shown in FIG. 4. Then, only said joint portion is cut off, so that a good product of cast slab 20A of the second grade of molten steel 20 different from constituent from the first grade of molten steel 14 from the first grade of cast slab 14A as shown in FIGS. 5A and 5B.

Additionally, according to the present invention, the depth of the cooling material being immersed and embedded in the molten steel contained in the mold is preferably large so as to secure the connecting strength by the use of the cooling material between the solidifed cast slab of the first grade of molten steel previously poured in and the solidified cast slab of the second grade of molten steel poured in later. However, in the case the depth is excessively large, the different grades of molten steel are mixed with each other, whereby the zone of the mixed and solidified cast slab is increased in size, which portion must be cut off later, thus decreasing the yield. Consequently, as viewed from the connecting strength, it is desirable to immerse the cooling material at least 50 mm in depth.

As described above, the solidified shell produced in the upper portion of the cast slab formed of the first grade of molten steel is utilized as the joint portion between the different grades of steel, the cooling material comprising the columnar steel stock having the guiding jigs and being circular or polygonal in cross section is put in and sunk in the unsolidified portion of said first grade of molten steel in the mold, whereby the upper and lower portions of the unsolidified portion is shut off from each other, the solidified layer formed around the steel stock of the cooling material is connected to the existing solidified shell, whereby the upper and lower portions of the unsolidified portion is shut off from each other by a shut-off layer 38 constituted by the cooling material and the solidified phase, and the second grade of molten steel is poured thereon, whereby the mixing can be reliably prevented which would otherwise occur between the first and second grades of molten steel.

EXAMPLE

Using a mold having width of 1275 mm and thickness of 220 mm, the process according to the present invention was applied in changing over from continuous casting of the first grade of molten steel having the chemical composition shown in Table 1 to continuous casting of the second grade of molten steel.

TABLE 1

| Grade of steel | Chemical composition (wt. %) | | | | | |
|---|---|---|---|---|---|---|
| | C | Si | Mn | P | S | Al |
| First grade of molten steel | 0.46 | 1.9 | 0.36 | 0.012 | 0.009 | 0.050 |
| Second grade of molten steel | 0.14 | 4.9 | 1.14 | 0.017 | 0.009 | 0.025 |

Firstly, upon stopping the pouring of the first grade of molten steel 14, the cooling material 28 as shown in FIG. 1 is put into the mold 12. The steel stock 28A has diameter of 100 mm and length of 1175 mm, and satisfies the condition of $V/S=2.5$ according to the aforesaid formula (1). The tundish was replaced simultaneously with the put-in of the cooling material. Upon stopping the pouring of the second grade of molten steel 20, casting was interrupted for only three minutes and then, the pouring of the second grade of molten steel 20 is started. The cast slab drawing speed after the pouring of the second grade of molten steel was set at 0.4 m/min. However, it was restored to the normal drawing speed of 1.0 m/min in five minutes. FIGS. 5A and 5B show the condition of the joint portion in cross section between the first and second grades of molten steel and the change in the concentration of manganese corresponding to the respective positions, wherein 0 indicates the center of the joint portion. Namely, studies were made on the cast slab 14A produced from the first grade of molten steel 14, the cast slab 20A produced from the second grade of molten steel 20 and the shut-off layer 38 constituting the joint portion between said two grades of molten steel in their cross sections, and as the result, it was found a shrinkage cavity 42 immediately beneath the position to which the cooling material 28 was sunk due to the formation of shut-off layer as shown in FIG. 3. The mixing zone 44 were the first and second grades of molten steel were mixed was about 10 cm in length. Study conducted on a sample picked up from a portion of the slab at the center of the width and at the depth of one half thereof made it clear that the mixing was completely prevented in portions forwardly and rearwardly of said mixing zone as shown in FIG. 5B. In addition, the shut-off layer 38 thus formed draws a parabolic line in cross section as shown in FIG. 4, the portion of the cast slab to be cut off was about 50 cm in length.

As apparent from the above embodiment, according to the present invention, in continuously casting the different grades of molten steel, upon stopping the pouring of the first grade of molten steel at first, the cooling material having the guiding jigs slightly smaller in cross section than the mold is immersed in the center portion of the mold so as to form a solidified phase around said cooling material, whereby said solidified phase is integrally connected to a solidified shell of the first grade of molten steel formed on the inner wall of the mold, thereby forming a shut-off layer for shutting the upper portion off the lower portion in the intermediate portion of the first grade of molten steel in the mold. Thereafter, the second grade of molten steel different in constituent from the first grade of molten steel is poured in before the upper surface of the first grade of molten steel disposed on the top of shut-off layer is solidified completely. As the result, the second grade of molten steel forms a solidified phase on the top of a solidified phase of the first grade of molten steel formed around said cooling material, and at the same time, forms newly a solidified steel thereof on the top of a solidified sheel of the first grade of molten steel on the inner surface of the mold, which integrally connected to the solidified phase of the second grade of molten steel formed around the cooling material, whereby the mixing with the first grade of molten steel is restricted to the minimum, thus enabling to restart the drawing.

Even if the drawing of the cast slab is started again as described above, the solidified phase of the first grade of molten steel surrounding the cooling material, the solidified phase integrally connected to the top of said solidified phase and the solidified shell of the second grade of molten steel laminated on the top of the solidified shell of the first grade of molten steel formed on the inner wall of the mold are all integrally, firmly connected and descend, so that such a trouble can be avoided that the molten steel leaks out due to the break in the joint portion, which is called break-out, thus allowing the different grades of cast slabs jointed with the second grade of cast slab to be smoothly drawn off and descend.

Further, in the process of continuously casting the different grades of molten steel according to the present invention, only three minutes of interruption in pouring molten steel is required, the workability in the change-over work is excellent. In addition to the above, since the mixing portion of the different grades of molten steel is as short as about 10 cm in the joint portion between the different grades of molten steel, the cast slab cut-off portion at the joint is as short as about 50 cm, thus presenting such an advantage that the yields of molten steel and cast slab can be significantly improved.

Furthermore, according to the present invention, the time during which continuous casting of the first grade of molten steel is changed over to that of the second grade of molten steel may be utilized for moving the shorter side plates of the mold, so that the change in width of the cast slab can be very easily carried out simultaneously with the change-over between the different grades of molten steel.

What is claimed is:

1. A method of sequential continuous casting wherein continuous casting of a first grade of molten steel is changed over to continuous casting of a second grade of molten steel different in constituent from the first grade of molten steel, comprising the steps of:

stopping the pouring of the first grade of molten steel into a mold;

immersing a cooling material formed of a columnar steel stock with its longitudinal axis parallel to one of the transverse axis of the mold and being circular or polygonal in cross section and equipped with guiding jigs transverse to its longitudinal axis into the substantially center portion of the first grade of molten steel in said mold, the length l and the largest transvere dimension d of said cooling material satisfying the following two formulas for said mold having the width of about 1500 mm and the thickness of about 220 mm Mold width—200 mm $<l<$ Mold width—100 mm Mold thickness—100 mm $<d<$ Mold thickness—20 mm;

forming around said cooling material a solified layer merging in a solidified shell developed from the wall of said mold; and pouring the second grade of molten steel into said mold before the surface of the first grade of molten steel above said cooling materials is solidified.

2. A method of sequential casting wherein continuous-casting of a first grade of molten steel is changed over to continuous casting of a second grade of molten different in constituent from the first grade of molten steel, comprising the steps of:

stopping the pouring of the first grade of molten steem into a mold;

immersing a cooling material formed of a columnar steel stock with its longitudinal axis parallel to one of the transverse axes of the mold and being circular or polygonal in cross section and equipped with guiding jibs transverse to its longitudinal axis into the substantially center portion of the first grade of molten steel in and mold to a depth of 50 mm or more as measured from the stop of said cooling material;

forming around said cooling material a solidfied layer merging in a solidified shell developed from the wall of said mold; and pouring the second grade of molten steel into said mold before the surface of the first grade of molten steel above said cooling material is solifidied.

* * * * *